US008428474B2

(12) United States Patent
Satomura

(10) Patent No.: US 8,428,474 B2
(45) Date of Patent: Apr. 23, 2013

(54) DEVELOPING DEVICE, PROCESS CARTRIDGE, AND IMAGE FORMING APPARATUS

(75) Inventor: Shogo Satomura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 356 days.

(21) Appl. No.: 12/953,730

(22) Filed: Nov. 24, 2010

(65) Prior Publication Data

US 2011/0123205 A1 May 26, 2011

(30) Foreign Application Priority Data

Nov. 26, 2009 (JP) ..... 2009-268425

(51) Int. Cl.
*G03G 15/08* (2006.01)
*G03G 21/00* (2006.01)

(52) U.S. Cl.
USPC ..... 399/27; 399/98

(58) Field of Classification Search ..... 399/27, 399/98, 99, 119, 263
See application file for complete search history.

(56) References Cited

U.S. PATENT DOCUMENTS 7,072,594 B2 * 7/2006 Hoshi et al. ..... 399/27
2006/0198643 A1 * 9/2006 Kimura et al. ..... 399/27
2008/0292331 A1 11/2008 Yokomori et al.
2009/0297175 A1 * 12/2009 Kakuta et al. ..... 399/27

FOREIGN PATENT DOCUMENTS

JP 2008-209897 A 9/2008

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

A developing device for developing with developer an electrostatic image formed on an image bearing member includes a developer carrying member; a developing chamber in which the developer carrying member is provided; a developer accommodating chamber, for accommodating developer to be fed to the developing chamber; a shaft rotatably supported in the accommodating chamber; a developer feeding member, mounted on the shaft; a light transmitting member for permitting light to pass into the accommodating chamber to detect an amount of the developer in the accommodating chamber; and a developer scattering preventing member provided on an inner wall of the accommodating chamber so as to overlap with the light transmitting member with respect to an axial direction of the shaft as seen in a direction perpendicular to the developer scattering preventing member, an upper end of the developer scattering preventing member being located below the light transmitting member.

10 Claims, 8 Drawing Sheets

DEVELOPING DEVICE, PROCESS CARTRIDGE, AND IMAGE FORMING APPARATUS

FIELD OF THE INVENTION AND RELATED ART

The present invention relates to a developing device for use with an electrophotographic image forming apparatus, a process cartridge detachably mountable to the electrophotographic image forming apparatus, and the image forming apparatus.

The electrophotographic image forming apparatus forms an image on a recording material by using an electrophotographic image forming method. Examples of the electrophotographic image forming apparatus may include, e.g., an electrophotographic copying machine, an electrophotographic printer (a laser beam printer, an LED printer, etc.), a facsimile machine, a word processor, and multi-function machines of these machines (such as a multi-function printer), and the like.

The developing device is a device for visualizing an electrostatic latent image on an image bearing member such as an electrophotographic photosensitive member by using a developer.

Further, the process cartridge is prepared by integrally assembling an electrophotographic photosensitive drum, and as a process means, a charging means, a developing means or a cleaning means into a cartridge, which is detachably mountable to a main assembly of the electrophotographic image forming apparatus. Further, the process cartridge is prepared by integrally assembling the electrophotographic photosensitive drum, and as the process means, at least one of the charging means, the developing means and the cleaning means into a cartridge, which is detachably mountable to the main assembly of the electrophotographic image forming apparatus. Further, the process cartridge is prepared by integrally assembling at least the electrophotographic photosensitive drum, and as the process means, the developing means into a cartridge, which is detachably mountable to the main assembly of the electrophotographic image forming apparatus.

In a conventional electrophotographic image forming apparatus using an electrophotographic image forming process, the electrophotographic photosensitive member and the process means acting thereon are integrally assembled into a cartridge. Further, the electrophotographic image forming apparatus employs a process cartridge type in which the cartridge is detachably mountable to the main assembly of the electrophotographic image forming apparatus. According to this process cartridge type, maintenance of the apparatus can be performed by a user by himself (herself) without relying on a service person, so that it is possible to remarkably improve operativity.

As one of conditions for exchanging the process cartridge, there is short of developer. Recently, detection of remaining developer amount has been carried out by various methods in order to notify the user of remaining developer amount information to urge the user to exchange the process cartridge smoothly.

As one of the methods, there is light transmission-type remaining developer amount detection (Japanese Laid-OPen Patent Application (JP-A) 2008-209897). In JP-A 2008-209897, detection light emitted from a light emitting portion such as the LED mounted to a main assembly of an electrophotographic image forming apparatus is introduced into a developer accommodating container through a light transmitting member which is mounted on the developer accommodating container of the image forming apparatus or the process cartridge.

The detection light entering the developer accommodating container passes through a light transmitting window or the like (or a reflecting mirror as another example) depending on a condition such as the remaining developer amount to travel to the outside of the developer accommodating container. Thereafter, the detection light is guided to a light receiving element (a light receiving portion such as a phototransistor) mounted on the image forming apparatus main assembly.

Further, inside the developer accommodating container, a rotatably supported developer feeding member is provided in order to feed the developer in a developing roller direction while stirring the developer. The developer feeding member has flexibility contacts an inner wall surface of the developer accommodating container in a state in which the developer feeding member carries the developer on its surface and is urged against an elastic force, thus being deformed. Then, by utilizing an elastic restoring force when the contact of the developer feeding member with the inner wall surface is released, the developer is moved upward and fed into a developing chamber provided above the developer feeding member. In this case, the detection light is blocked when the developer feeding member and the developer pass through a detection window. Further, with a smaller remaining developer amount, a blocking time of light by the developer becomes shorter, so that a transmission time of light becomes longer. In such a manner, the transmission time of the detection light is detected, so that the remaining developer amount in the developer accommodating container can be detected. The above-described method is the light transmission-type remaining developer amount detection.

Here, in the developer accommodating chamber, the developer can be scattered in the case where the developer is fed by utilizing the restoring force of the developer feeding member having flexibility and the case where there is a need to rotate the developer feeding member at high speed with speed-up of printing.

The scattering of the developer may be attributable to vigorous falling of the developer scooped up by the developer feeding member from the developer feeding member or an air flow occurring during elimination of deformation of the flexible developer feeding member. When the developer is scattered in the developer accommodating container, there is a possibility that the scattered developer blocks the detection light depending on a mounting position of the light transmitting member or the remaining amount of the developer in the developer accommodating container, so that the detection accuracy in the light transmission-type remaining developer detection is lowered in some cases.

SUMMARY OF THE INVENTION

A principal object of the present invention is to provide a developing device capable of detecting a remaining developer amount with accuracy even in the case where a developer feeding member is rotated at high speed or in the case where developer is fed by a restoring force of the developer feeding member.

Another object of the present invention is to provide a process cartridge including the developing device and an image forming apparatus including the process cartridge.

According to an aspect of the present invention, there is provided a developing device for developing with a developer an electrostatic image formed on an image bearing member, the developing device comprising:

a rotatable developer carrying member for carrying and conveying the developer to the image bearing member;

a developing chamber in which the developer carrying member is provided;

a developer accommodating chamber, disposed and separated from the developing chamber by a wall surface provided with an opening through which the developer is passable, for accommodating the developer to be fed to the developing chamber;

a rotation shaft rotatably supported in the developer accommodating chamber;

a developer feeding member, mounted on the rotation shaft at one end thereof with respect to a radial direction of the rotation shaft, for feeding the developer by rotation of the rotation shaft while being deformed in contact with an inner wall of the developer accommodating chamber at the other end thereof;

a light transmitting member for permitting detection light to pass into the developer accommodating chamber in order to detect an amount of the developer in the developer accommodating chamber, wherein the light transmitting member is mounted on a wall surface of the developer accommodating chamber at a position upstream of the opening with respect to a rotational direction of the rotational shaft and downstream of a line of intersection between a vertical surface including an axis of the rotation shaft and a bottom constituting the developer accommodating chamber with respect to the rotational direction; and a developer scattering preventing member provided on the inner wall of the developer accommodating chamber so as to overlap with the light transmitting member with respect to an axial direction of the rotation shaft as seen in a direction perpendicular to the developer scattering preventing member, wherein an upper end of the developer scattering preventing member is located below the light transmitting member.

According to the present invention, by providing the developer scattering preventing member, the developer falling from the developer feeding member is blocked to reduce a degree of scattering of the developer, so that an amount of blocking of the light transmitting member with the developer can be suppressed. Therefore, detection of the remaining amount of the developer can be performed with accuracy.

According to another aspect of the present invention, there is provided a process cartridge detachably mountable to a main assembly of an image forming apparatus. The process cartridge comprises:

an image bearing member on which an electrostatic image is to be formed;

a developing chamber in which the developer carrying member is provided;

a developer accommodating chamber, disposed and separated from the developing chamber by a wall surface provided with an opening through which the developer is passable, for accommodating the developer to be fed to the developing chamber;

a rotation shaft rotatably supported in the developer accommodating chamber;

a developer feeding member, mounted on the rotation shaft at one end thereof with respect to a radial direction of the rotation shaft, for feeding the developer by rotation of the rotation shaft while being deformed in contact with an inner wall of the developer accommodating chamber at the other end thereof;

a light transmitting member for permitting detection light to pass into the developer accommodating chamber in order to detect an amount of the developer in the developer accommodating chamber, wherein the light transmitting member is mounted on a wall surface of the developer accommodating chamber at a position upstream of the opening with respect to a rotational direction of the rotational shaft and downstream of a line of intersection between a vertical surface including an axis of the rotation shaft and a bottom constituting the developer accommodating chamber with respect to the rotational direction; and a developer scattering preventing member provided on the inner wall of the developer accommodating chamber so as to overlap with the light transmitting member with respect to an axial direction of the rotation shaft as seen in a direction perpendicular to the developer scattering preventing member, wherein an upper end of the developer scattering preventing member is located below the light transmitting member.

According to the present invention, by providing the developer scattering preventing member, the developer falling from the developer feeding member is blocked to reduce a degree of scattering of the developer, so that an amount of blocking of the light transmitting member with the developer can be suppressed. Therefore, detection of the remaining amount of the developer can be performed with accuracy.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

(General Structure of Electrophotographic Image Forming Apparatus)

Figure 1:
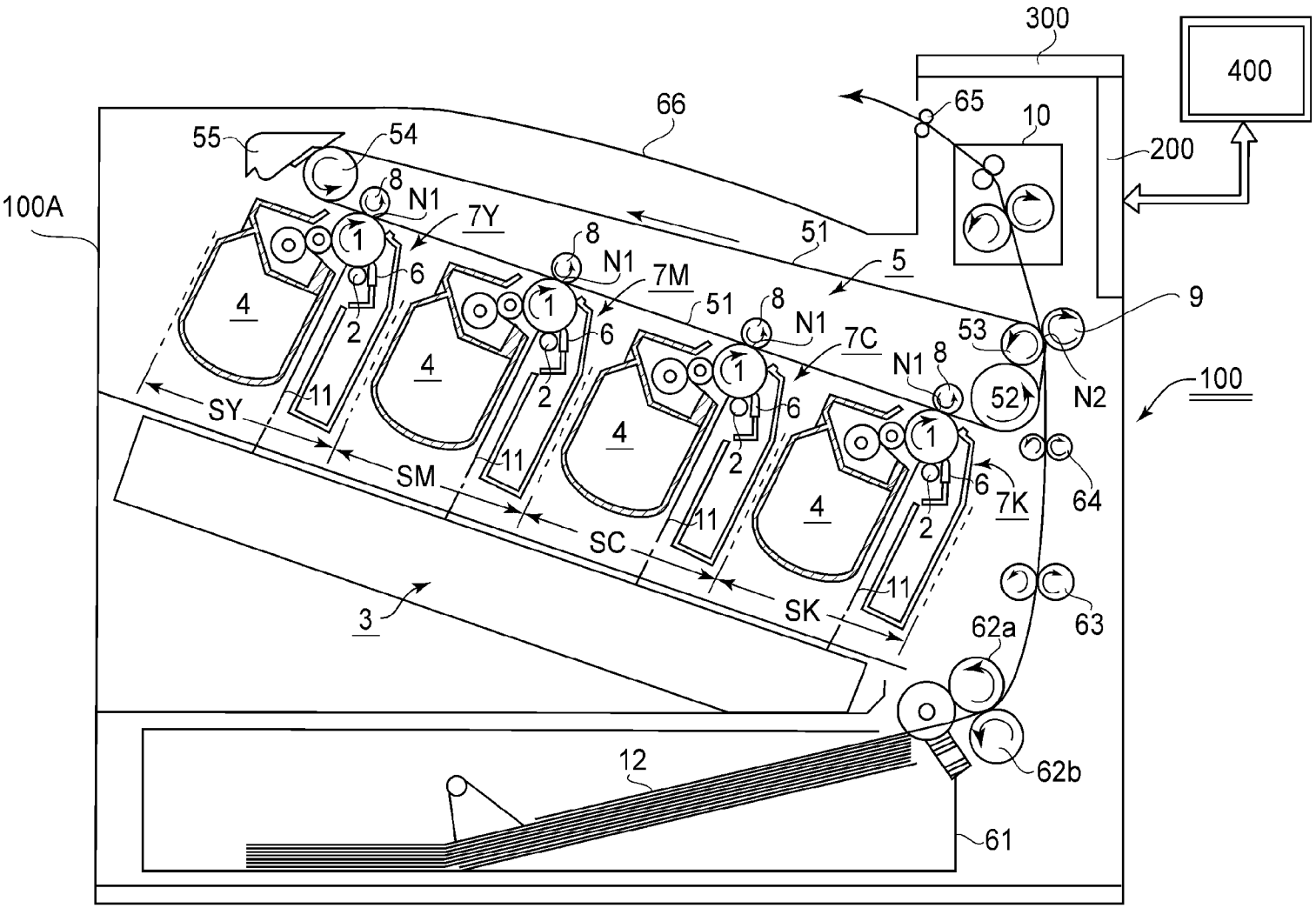
FIG. 1 is a sectional view showing a schematic structure of an image forming apparatus in an embodiment.

FIG. 1 is a schematic sectional view of an electrophotographic image forming apparatus (hereinafter referred to as an apparatus) 100 in this embodiment. The apparatus 100 is a full-color laser beam printer of an in-line type and of an intermediary transfer type. That is, the apparatus 100 is capable of forming a full-color image on a recording material (e.g., recording sheet, plastic sheet, fabric, or the like) 12 according to electrical image information inputted from a host device 400 into a control circuit portion 200. The host device 400 is an image reading device (image reader), a personal computer, or the like which are communicatably connected to the apparatus 100. The control circuit portion 200 transfers various pieces of electrical information between itself and the host device 400 or an operating portion 300 and effects centralized control of an image forming operation in accordance with a predetermined program or a predetermined reference table.

In the apparatus 100, from the left side to the right side in FIG. 1, as a plurality of image forming portions S, first to fourth (four) image forming portions SY, SM, SC and SK for forming toner images different in color are juxtaposed in line in a direction in which the image forming portions are sloped downward from the horizontal direction. In this embodiment, the first image forming portion SY forms the toner image of yellow (Y) and the second image forming portion SM forms the toner image of magenta (M). The third image forming portion SC forms the toner image of cyan (C) and the fourth image forming portion SK forms the toner image of black (K).

Each of the image forming portions S is an electrophotographic process mechanism having the substantially same structure except that the color of toner as the developer accommodated in a developing means is different from each other. Each image forming portion S includes a drum type electrophotographic photosensitive member (hereinafter referred to as a drum) 1 as a rotatable image bearing member on which an electrostatic image (electrostatic latent image) is to be formed. Further, each image forming portion S includes a charging means 2, a developing means 4 and a cleaning means 6 which are process means acting on the drum 1. The charging means 2 uniformly charges the surface of the drum 1 to a predetermined polarity and a predetermined potential and in this embodiment, a charging roller which is a contact charging member is used. The developing means 4 develops the electrostatic image formed on the surface of the drum 1 as the toner image and in this embodiment, a contact type developing device (hereinafter referred to as a developing unit using a non-magnetic one component developer (non-magnetic toner) is used. The cleaning means 6 removes the developer (toner) remaining on the drum surface after the toner image is transferred from the drum 1 onto an intermediary transfer member. In this embodiment, as the cleaning means 6, a blade cleaning member counterdirectionally contacted to the drum 1 at its edge portion with respect to a drum rotational direction.

At each image forming portion S, the drum 1, the charging roller 2, the developing unit 4 and the cleaning member 6 are integrally assembled into a cartridge, which is detachably mountable to an apparatus main assembly 100A. That is, process cartridges 7 (7Y, 7M, 7C and 7K) are prepared. The apparatus main assembly 100A has a constitution in which the cartridges 7 are removed from the apparatus 100. Each cartridge 7 is detachably mounted in the apparatus main assembly 100A through mounting means such as a mounting guide and positioning member which are provided in the apparatus main assembly 100A.

Below and above the respective image forming portions S, an exposure unit (scanner unit or exposure device) 3 as an exposure means and an intermediary transfer unit 5 are provided, respectively. The exposure unit 3 forms the electrostatic image by irradiating the drum 1 of each image forming portion S with laser light 11 which has been modulated on the basis of image information. The intermediary transfer unit 5 includes an endless intermediary transfer belt 51 having flexibility (hereinafter referred to as a belt) as a movable intermediary transfer member contacted to an upper surface of the drum 1 of each image forming portion S. The belt 51 is extended and stretched around three rollers consisting of a driving roller 52 and a secondary transfer opposite roller 53 which are disposed on the fourth image forming portion SK side, and a follower roller 54 disposed on the first image forming portion SY side. Inside the belt 51, four primary transfer rollers 8 as a primary transfer means are disposed correspondingly to the image forming portions S, respectively. Each primary transfer roller 8 presses a lower-side belt portion of the belt 51 against the upper surface of the drum 1 with a predetermined urging force. At each image forming portion S, a contact portion between the drum 1 and the belt 51 is a primary transfer portion (primary transfer nip) N1. Further, toward the secondary transfer opposite roller 53, a secondary transfer roller 9 as a secondary transfer means is pressed against the belt 51 with a predetermined urging force. A contact portion between the secondary transfer roller 9 and the belt 51 is a secondary transfer portion (secondary transfer nip) N2. The primary transfer rollers 8 and the secondary transfer roller 9 are electroconductive rollers having the same constitution.

An operation for forming a full-color image is as follows. The control circuit portion 200 starts an image forming operation of the apparatus 100 on the basis of a print start signal. That is, the drum 1 of each image forming portion S is rotationally driven in the clockwise direction indicated by an arrow at a predetermined speed by a driving means (not shown) while being timed to image formation. The belt 51 is also rotationally driven (circulated and moved) in the counterclockwise direction indicated by an arrow (codirectionally with the drum rotation direction at their contact portion) at a speed corresponding to the drum rotation speed by the drive of the driving roller 52. Further, the exposure unit 3 is driven. In synchronism of the drive of these members, at each image forming portion S, a predetermined charging bias is applied from a charging bias voltage source (not shown) to the charging roller 2, so that the surface of the drum 1 is uniformly charged to the predetermined polarity and potential. The exposure unit 3 subjects the surface of each drum 1 is scanning exposure with the laser light 11 which has been modulated depending on the image information signal of each color of Y, M, C or K. As a result, on the surface of the drum 1, the electrostatic image depending on the image information signal for a corresponding color is formed. The thus formed electrostatic image is developed into the toner image by the developing unit 4.

In the apparatus 100 in this embodiment, the drum 1 of each image forming portion S is negatively charged to the predetermined potential by the charging roller 2 and then, the electrostatic image is formed by the exposure unit 3 in accordance with an image exposure method. The electrostatic image is reversely developed by the developing unit 4 with the (negative) toner of the negative polarity as a normal charge polarity of the toner, so that the electrostatic image is visualized as the toner image. That is, the developing unit 4 deposits the toner, normally charged to the same polarity (negative polarity) as a charge polarity of the drum 1, on a portion (image portion or exposed portion) where electric charge is attenuated by the exposure of the drum 1 to light, so that the electrostatic image is developed.

By the electrophotographic image forming process described above, the toner image of Y corresponding to a yellow component of the full-color image is formed on the drum 1 of the first image forming portion SY and then is primary-transferred onto the belt 51 at the primary transfer portion N1 of the image forming portion SY. The toner image of M corresponding to a magenta component of the full-color image is formed on the drum 1 of the second image forming portion SM and then is superposedly primary-transferred onto the toner image of Y which has already been transferred onto the belt 51 at the primary transfer portion N1 of the image forming portion SM. The toner image of C corresponding to a cyan component of the full-color image is formed on the drum 1 of the third image forming portion SC and then is superposedly primary-transferred onto the toner images of Y and M which have already been transferred onto the belt 51 at the primary transfer portion N1 of the image forming portion SC. The toner image of K corresponding to a black component of the full-color image is formed on the drum 1 of the fourth image forming portion SK and then is superposedly primary-transferred onto the toner images of Y, M and C which have already been transferred onto the belt 51 at the primary transfer portion N1 of the image forming portion SK. To the primary transfer roller 8 of each image forming portion S, with predetermined control timing, a primary transfer bias which has an opposite polarity to the normal charge polarity of the toner and has a predetermined potential is applied from the primary transfer bias voltage source (not shown).

In this manner, on the travelling belt 51, unfixed toner images of Y, M, C and K for a four color-based full-color image are synthetically formed. These unfixed toner images are conveyed to reach the secondary transfer portion N2 by further movement of the belt 51. At each image forming portion S, primary transfer residual toner remaining on the drum surface after the primary transfer of the toner images onto the belt 51 is removed by the cleaning member 6. The drum surface which has been cleaned is subjected to a subsequent image forming step.

On the other hand, a recording material 12 stacked in a sheet feeding cassette 61 is fed one by one by a sheet feeding roller 62*a* and a retarding roller 62*b* with predetermined control timing and then is conveyed to a registration roller pair 64 by conveying rollers 63. The recording material 12 is conveyed to the secondary transfer portion N2 by the registration roller pair 64 with predetermined control timing. To the secondary transfer roller 9, with predetermined control timing, a secondary transfer bias which has the opposite polarity to the normal charge polarity and has the predetermined potential is applied from a secondary transfer bias voltage source (not shown). As a result, in a process in which the recording material 12 is nip-conveyed in the secondary transfer portion N2, the four color toner images superposed on the belt 51 are collectively secondary-transferred onto the surface of the recording material 12. The recording material 12 coming out of the secondary transfer portion N2 is separated from the belt 51 is conveyed into a fixing unit 10 as a fixing means, in which the toner images are fixed on the recording material 12. The fixing of the toner images on the recording material 12 is performed by applying heat and pressure to the recording material 12. The recording material 12 coming out of the fixing unit 10 is discharged onto a sheet discharging tray 66 by sheet discharging rollers 65. Secondary transfer residual toner remaining on the surface of the belt 51 after the secondary transfer of the toner images onto the recording material 12 is removed by a belt cleaning device 55. The belt surface which has been cleaned is subjected to the subsequent image forming step. Incidentally, the apparatus 100 is also capable of forming a monochromatic image or a multi-color image by using only one image forming portion or some (not the all of) image forming portions as desired.

(Process Cartridge)

Figure 2:
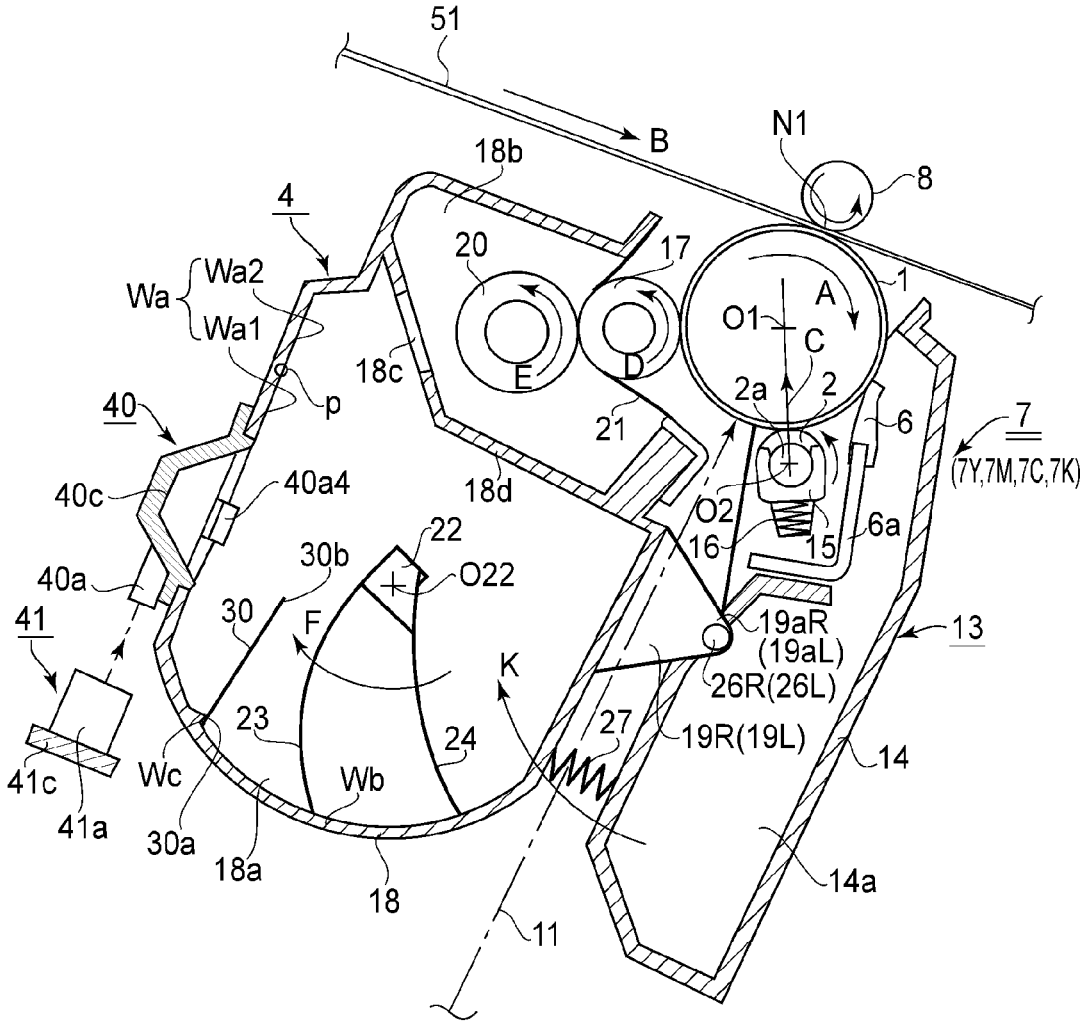
FIG. 2 is an enlarged cross-sectional view of one cartridge portion.

The cartridges 7 of the image forming portions S have the same structure except that the colors of the toners accommodated in the developing units 4 are different from each other, i.e., Y, M, C and K as described above. FIG. 2 is an enlarged cross-sectional view of one cartridge portion of those of the image forming portions S. The cartridge 7 is connected product which is roughly divided into a photosensitive drum unit 13 and a developing unit 4.

The photosensitive drum unit 13 is prepared by integrally supported the drum 1, the charging roller 2 and the cleaning member 6 on a cleaning member frame 14. The cleaning member frame 14 is a member extending in a rotational axis direction of the drum 1 as its longitudinal direction. The drum 1 is rotatably mounted and supported by the cleaning member frame 14 at longitudinal end portions through bearings (not shown). Further, the cleaning member frame 14, a blade cleaning member (elastic rubber blade) 6 is mounted through a supporting metal plate 6*a*. The cleaning member 6 is an elongated member extending along the drum 1 so as to be substantially parallel to the drum 1. An edge portion of the cleaning member 6 with respect to a widthwise direction is urged against the drum 1 counterdirectionally to the drum rotational direction with a predetermined urging force.

Further, on each of longitudinal end sides of the cleaning member frame 14, a charging roller bearing 15 is mounted movably in a direction of an arrow C toward a center O1 of the drum 1 on a rectilinear line passing through a center O2 of the charging roller 2 and the center O1 of the drum 1. A shaft 2*a* of the charging roller 2 on each of longitudinal end sides is rotatably supported by an associated bearing 15. The charging roller 2 is disposed in substantially parallel to the drum 1 and is elongated along the drum 1. The bearing 15 on each of the longitudinal end sides is urged toward the drum 1 by an urging member 16. As a result, the charging roller 2 contacts the drum 1 with a predetermined urging force.

A developing container (developing device frame) 18 of the developing unit 4 includes a developer accommodating chamber (toner chamber) 18*a* accommodating the toner (developer T in FIG. 8) and a developing chamber 18*b* disposed above the toner chamber 18*a*. The developing device frame 18 is an elongated in its longitudinal direction parallel to the rotational axis direction of the drum 1. The toner chamber 18*a* and the developing chamber 18*b* are partitioned by a wall surface 18*d* provided with an opening 18*c* for permitting passing of the toner therethrough. In the developing chamber 18*b*, a developing roller 17 having an elastic layer as a developer carrying member for supplying the toner to the drum 1 in contact with the drum 1 is disposed. The developing roller 17 is disposed in substantially parallel to the drum 1 and is an elongated along the drum 1. Further, in the developing chamber 18*b*, a toner supplying roller 20 having an elastic sponge layer as a developer supplying member to the developing roller 17 is disposed in parallel to and in contact with the developing roller 17. The supplying roller 20 is elongated along the developing roller 17. The longitudinal end portions of the developing roller 17 and the supplying roller 20 are rotatably mounted and supported through bearings (not shown) on the longitudinal end sides of the developing device frame 18. Further, in the developing chamber 18*b*, a developing blade 21 as a developer layer thickness regulating member for regulating the toner layer on the developing roller 17 is disposed. The developing blade 21 is elongated along the developing roller 17. The developing blade 21 is fixed on the developing device frame 14 on its widthwise end side and is tangentially contacted elastically to the developing roller 17 on the other end side.

Inside the toner chamber 18*a*, a rotation shaft 22 is provided. The rotation shaft 22 is rotatably mounted on the developing device frame 18 through bearings (not shown) on its longitudinal end sides. On this rotation shaft 22, a flexible toner feeding member (developer feeding member) 23 for feeding the toner is mounted. Further, on the rotation shaft 22, a flexible cleaning member 24 is mounted. This cleaning member 24 rubs against and cleans a light transmitting window 40*a*4 which is a light emitting window and a light transmitting window 40*b*4 which is a light receiving window of a light transmitting member 40*d* which is disposed in the toner chamber 18*a* for detecting an amount of the toner in the toner chamber 18*a* and will be described later. The toner feeding member 23 and the cleaning member 24 are rotated in a predetermined direction F in the toner chamber 18*a* at a predetermined speed by rotational drive of the rotation shaft 22. Further, on an inner wall bearing surface We on an inner wall bottom portion Wb of the toner chamber 18*a*, a developer scattering preventing member (toner scattering preventing member) 30 for holding back the toner which is dropped from the toner feeding member 23 into the toner container is provided.

The developing unit 4 is rotatably connected to the photosensitive member unit 13 about shafts 26R (26L) engaged in holes 19Ra (19La) provided in bearing members 19R (19L) which are provided on the longitudinal end sides of the developing device frame 18. Further, the develop unit 4 is rotationally urged in a direction of an arrow K about the shafts 26R (26L) by an urging spring 27 which is compressedly disposed between itself and the photosensitive member unit 13. The rotational direction of the developing unit 4 indicated by the arrow K is a direction in which the developing roller 17 is urged against the drum 1 of the photosensitive member unit 13 with a predetermined urging force. Here, the contact of the developing roller 17 with the drum 1 may also be realized by a constitution in which the developing roller 17 itself is contacted to the drum 1 (contact development). Further, it is also possible to employ a constitution in which spacer rollers provided at end portions of the developing roller 17 contact the drum 1 to place the developing roller 17 in a non-contact opposing state to the drum 1 with a predetermined slight gap (non-contact development).

The cartridge 7 at each image forming portion S is detachably mounted at an associated cartridge mounting portion on the apparatus main assembly 100A side in a predetermined manner. FIG. 2 shows a state in which the cartridge 7 is properly mounted at the mounting portion (not shown). In the mounting state of the cartridge 7, the photosensitive member unit 13 is rotatably fixed and held relative to a positioning portion of the mounting portion. The developing unit 4 is in a free state and is rotationally urged about the shafts 26R (26L) in the arrow K direction with the predetermined urging force of the urging spring 27, so that the developing roller 17 or the spacer rollers are contacted to the drum 1 with a predetermined urging force. Further, in the mounting state of the cartridge 7, a drive output portion (not shown) of the apparatus main assembly 100A is mechanically connected to a drive input portion (not shown) of the photosensitive member unit 13. Further, to an electric input portion (not shown) of the photosensitive member unit 13, an electric output portion (not shown) of the apparatus main assembly 100A is electrically connected. As a result, the apparatus 100 is capable of performing the image forming operation.

That is, by a driving force inputted from the drive output portion to the drive unit portion, the drum 1 is rotationally driven in the clockwise direction of the arrow A at the predetermined speed. The charging roller 2 is rotated by the rotation of the drum 1. To the charging roller 2, a predetermined charging bias to be inputted from the electric output portion to the electric input portion is applied. As a result, the surface of the drum 1 is uniformly charged to the predetermined polarity and potential. The exposure of the charged surface of the drum 1 to light is made by causing the laser light 11 outputted from the exposure unit 3 to enter a gap path between the photosensitive member unit 13 and the developing unit 4 from a lower side to an upper side thereby to subject the lower surface of the drum 1 to scanning exposure. As a result, the electrostatic image corresponding to an scanning exposure image is formed on the surface of the drum 1.

Further, the driving force from the photosensitive member unit 13 is also transmitted to the developing roller 17, the supplying roller 20 and the rotation shaft 22 on the developing unit 4 side. The developing roller 17 is rotationally driven at the predetermined speed in the counterclockwise direction of the arrow D counterdirectionally to the rotational direction of the arrow A of the drum 1 at their contact portion. The supplying roller 20 is also rotationally driven in the counterclockwise direction of the arrow E at a predetermined speed. The developing roller 17 and the supplying roller 20 are rotated counterdirectionally to each other at their contact portion, so that the toner in the developing chamber 18*b* is applied from the supplying roller onto the developing roller 17. The toner applied on the developing roller 17 is regulated by the developing blade 21 so as to provide a predetermined layer thickness and is conveyed to a developing position which is a contact portion between the developing roller 17 and the drum 1 by further rotation of the developing roller 17. Further, to the developing roller 17, a predetermined developing bias to be inputted from the electric output portion to the electric input portion is applied. As a result, the electrostatic image on the position surface is developed into the toner image by the developing roller 17. The development residual toner remaining on the developing roller 17 is returned to the contact portion between the developing roller 17 and the supplying roller 20 by further rotation of the developing roller 17 and is removed by the supplying roller 20. Then, the toner is applied again from the supplying roller 20 onto the developing roller 17.

Then, the toner image formed on the drum surface is conveyed to the primary transfer portion N1 by further rotation of the drum 1 and is successively primary-transferred onto the surface of the belt 51 travelling in the arrow B direction. The primary transfer residual toner on the drum surface after the primary transfer of the toner image onto the belt 51 is removed by the cleaning member 6. The removed toner is dropped into a removed toner chamber 14*a* of the cleaning member frame 14.

(Toner Feeding Constitution)

The rotation shaft 22 in the toner chamber 18*a* is rotationally driven in a direction of an arrow F at a predetermined speed, and the toner feeding member 23 and the cleaning member 24 which are mounted on the rotation shaft 22 are also rotationally driven in the clockwise direction of the arrow F in the toner chamber 18*a* together with the rotation shaft 22. The toner feeding member 23 stirs the toner accommodated in the toner chamber 18*a* and is configure to feed the toner toward the toner supplying roller 20 in the developing chamber 18*b*. By the rotation of the toner feeding member 23, the toner in the toner chamber 18*a* is stirred and scooped and a part of the toner is moved upward by the elastic restoring force of the toner feeding member 23, so that the toner is fed toward the toner supplying roller 20 in the developing chamber 18*b* through the opening 18*c*.

This operation will be described more specifically. Referring to FIG. 2, the toner chamber 18*a* has a bottom wall surface Wb as a bottom and an inclined wall surface Wa along a rotational direction F of the toner feeding member 23. The inclined wall surface Wa has a contact portion Wa 1 contactable to the toner feeding member 23 and a non-contact portion Wa 2 which is located downstream of the contact portion Wa1 and upstream of the opening 18*c* with respect to the rotational direction of the toner feeding member 23 and is not in contact with the toner feeding member 23.

The toner feeding member 23 is bent (urged) against its elastic force by press-contact (sliding) with the bottom wall surface Wb and the contact portion Wa1, thus being deformed convexly toward the downstream side with respect to the rotational direction. Further, the toner feeding member 23 is configured to feed the toner in a state in which it carries the toner on its surface on its rotational direction downstream side by being rotated in a contact state with the bottom wall surface Wb and the contact surface Wa1. When a free end (opposite to an end on the rotation shaft 22 side) of the toner feeding member 23 reaches the non-contact portion Wa2, the rotation of the toner feeding member 23, the press-contact of the toner feeding member 23 with the inner wall surface of the toner chamber 18*a* is eliminated. When the press-contact of the toner feeding member 23 is eliminated, the toner feeding member 23 is liable to change its shape to a natural state (an original shape) by its own elastic restoring force. By this shape change of the toner feeding member 23 in the restoring direction, the toner which is carried and fed on the toner feeding member 23 is leaped up, against gravity, toward the opening 18*c* provided above the toner chamber 18*a*. A part of the toner is fed to the toner supplying roller 20 in the developing chamber 18*b* through the opening 18*c*. Here, in this embodiment, a boundary point P between the contact portion Wa1 and the non-contact portion Wa2 is provided above the light transmitting (emitting) window 40*a*4 and the light transmitting (receiving) window 40*b*4 of the light transmitting member 40 described below.

(Light Transmitting Member)

Figure 3:
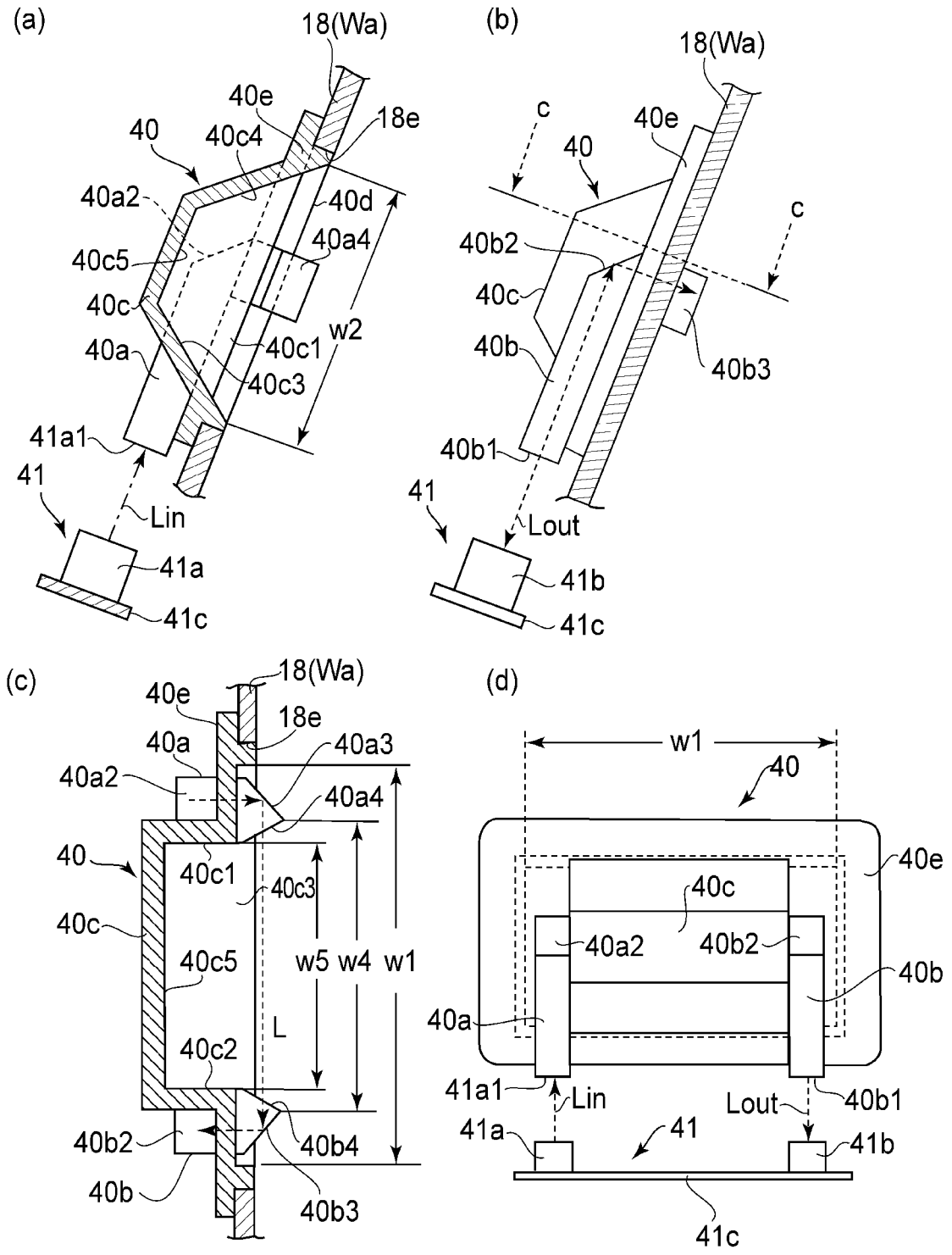
FIGS. 3(*a*) to 3(*d*) are schematic structural views of a light transmitting member.
Figure 4:
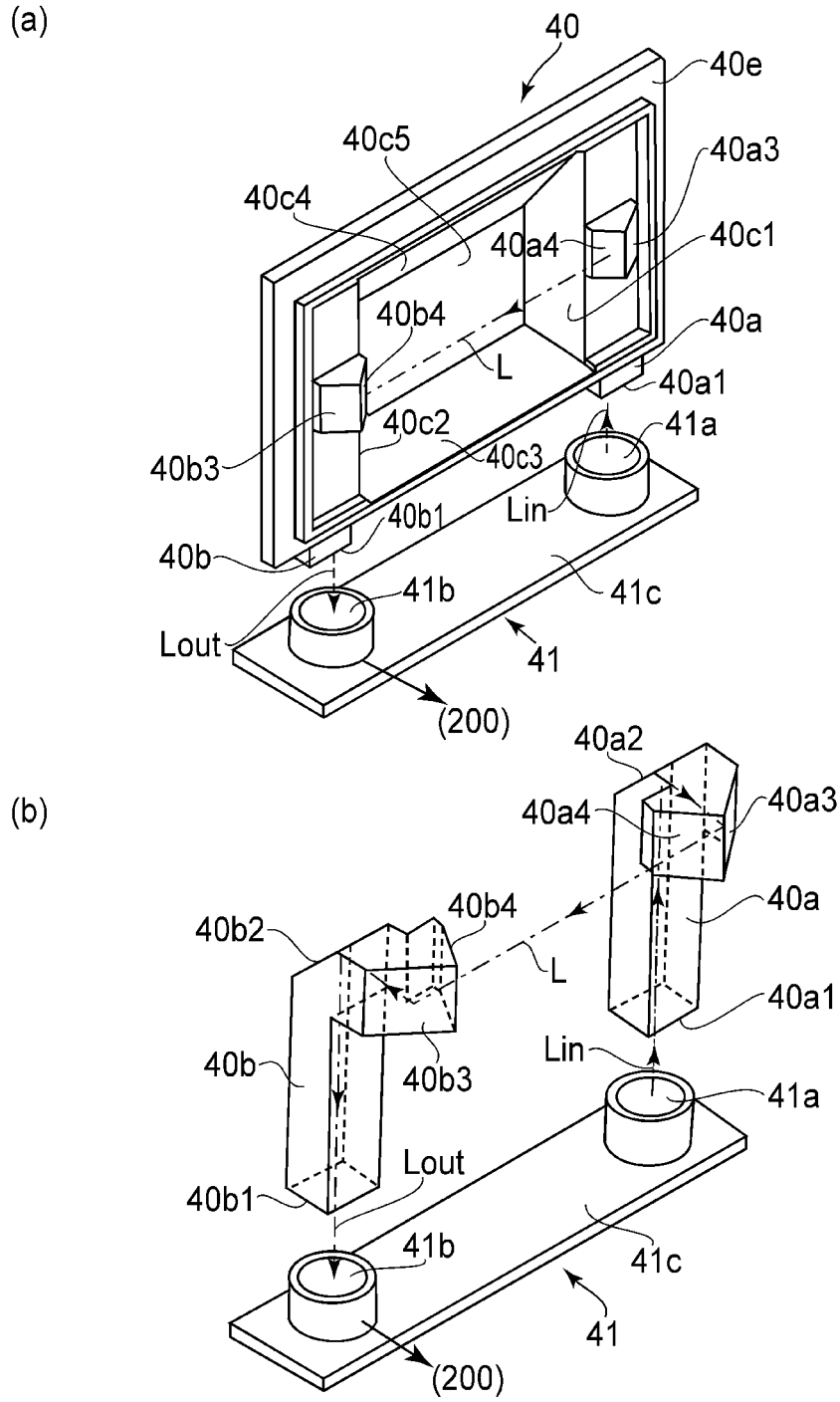
FIGS. 4(*a*) and 4(*b*) are schematic structural views of the light transmitting member.

In the neighborhood of the center of the wall surface Wa constituting the toner chamber 18*a* of the developing device frame 18 with respect to a longitudinal direction of the developing roller 17, the light transmitting member 40 as a toner detecting member for performing light-transmission type detection of the remaining developer (toner) amount is externally provided. FIG. 3(*a*) is an enlarged view of the light transmitting member 40 portion in FIG. 2, FIG. 3(*b*) is a side view of the light transmitting member 40 on a light receiving guide portion 40*b* side, FIG. 3(*c*) is a sectional view along c-c line in FIG. 3(*b*), and FIG. 3(*d*) is an outer surface view of the light transmitting member 40. FIG. 4(*a*) is a perspective view of the light transmitting member 40 as seen from an inner surface side, and FIG. 4(*b*) is a perspective view of a light emitting guide portion 40*a*, the light receiving guide portion 40*b* and a detecting unit 41.

The light transmitting member 40 includes the light emitting guide portion 40*a* and the light receiving guide portion 40*b* which are externally mounted on a supporting member 40*e*. At a light transmitting member mounting position of the wall surface Wa of the toner chamber 18*a*, an opening 18*e* is provided. The light transmitting member 40 is disposed opposed to the toner chamber 18*a* by fixing the supporting member 40*e* on the wall surface Wa from the outside of the wall surface Wa so that an inner surface of the light transmitting member 40 corresponds to the opening 18*a*. At a central portion of the supporting member 40*e*, the detecting portion 40*c* having a shape projected toward the outside of the toner feeding member 23 with respect to a direction of the radius of gyration of the toner feeding member 23 is formed. The light emitting guide portion 40*a* and the light receiving guide portion 40*b* are disposed outside the supporting member 40*e* is a vertical direction on both sides of the detecting portion 40*c*. The detecting portion 40*c* is a box-like space which communicates with the toner chamber 18*a* and is provided with an opening 40*d* having a long-side length w1 and short-side length w2. That is, the detecting portion 40*c* includes both side walls 40*c*1 and 40*c*2 oppositely disposed with respect to the rotational direction of the toner feeding member 23, wall surfaces 40*c*3 and 40*c*4 formed oppositely to each other on an upstream side and a downstream side, respectively, with respect to the rotational direction of the toner feeding member 23, and a wall surface 40*c*5 disposed oppositely to the opening 40*d*.

The light transmitting member 40 is positioned above and correspondingly to the detecting unit 41 disposed at a predetermined position of the apparatus main assembly 100A in a predetermined manner in a state in which the cartridge 7 is mounted in the apparatus main assembly in a predetermined manner and the developing roller 17 contacts the drum 1. The developing unit 41 includes a light emitting portion (e.g., LED) 41*a* for emitting detection light L in toward an incident surface 40*a*1 which is a lower end surface of the light emitting guide portion 40*a*. Further, the developing unit 41 includes a light receiving portion (e.g., photo-transistor) 41*b* for receiving detection light Lout outgoing from an outgoing surface 401*b*1 which is a lower end surface of the light receiving guide portion 40*b*. The light emitting portion 41*a* and the light receiving portion 41*b* are disposed on the supporting member 41*c*, which is fixed and provided on a stationary member (not shown) of the apparatus main assembly 100A.

On upper end sides of the light emitting guide portion 40*a* and the light receiving guide portion 40*b*, the light transmitting windows 40*a*4 and 40*b*4 are provided, respectively. These light transmitting windows 40*a*4 and 40*b*4 are positioned inside the supporting member 40*e*. The light transmitting window 40*a*4 of the light emitting guide portion 40*a* and the light transmitting window 40*b*4 of the light receiving guide portion 40*b* are, as shown in FIG. 3(*c*), disposed opposed to each other along the rotational axis direction of the toner feeding 23. The detection light Lin emitted from the light emitting portion 41*a* of the detection unit 41 is introduced from the incident surface 40*a*1 into the light emitting guide portion 40*a*. The detection light Lin is polarized by a reflection surface 40*a*2 of the light emitting guide portion 40*a* and introduced into the toner chamber 18*a*. The polarized detection light is further polarized by a reflection surface 40*a*3 and introduced from the light transmitting window 40*a*4 into the toner chamber 18*a*. The outgoing detection light Lin from the light transmitting window 40*a*4 of the light emitting guide portion 40*a* passes through the inside of the toner chamber 18*a* and is introduced into the oppositely disposed light transmitting window 40*b*4 of the light receiving guide portion 40*b*. Thereafter, the detection light L is polarized by reflection surfaces 40*b*3 and 40*b*2 of the light receiving guide portion 40*b* and passes through the light receiving guide portion 40*b* to go from an outgoing surface 40*b*1 to the outside of the light transmitting member 40 (the outside of the cartridge 7). The outgoing detection light Lout enters the light receiving portion 41*b* of the detection unit 41. In this embodiment, as shown in FIG. 3(*c*), the oppositely disposed light transmitting windows 40*a*4 and 40*b*4 are configured so that a distance w4 therebetween on a side where they are close to the toner chamber 18*c* is more than a distance w5 therebetween on a side where they are away from the toner chamber 18*c*, i.e., w4>w5.

The toner in the toner chamber 18*a* is stirred and conveyed while being moved upward along the inner wall surface of the toner chamber 18*a* in cross section by the rotational drive of the toner feeding member 23 in the arrow F direction at the predetermined speed depending on the image forming operation. Then, a part of the stirred and conveyed toner is sent into the developing chamber 18*b* through the opening 18*c* to be used for the image formation. The toner accommodated in the toner chamber 18*a* is successively sent into the developing chamber 18*b* and is gradually decreased with the use for the image formation.

Figure 5:
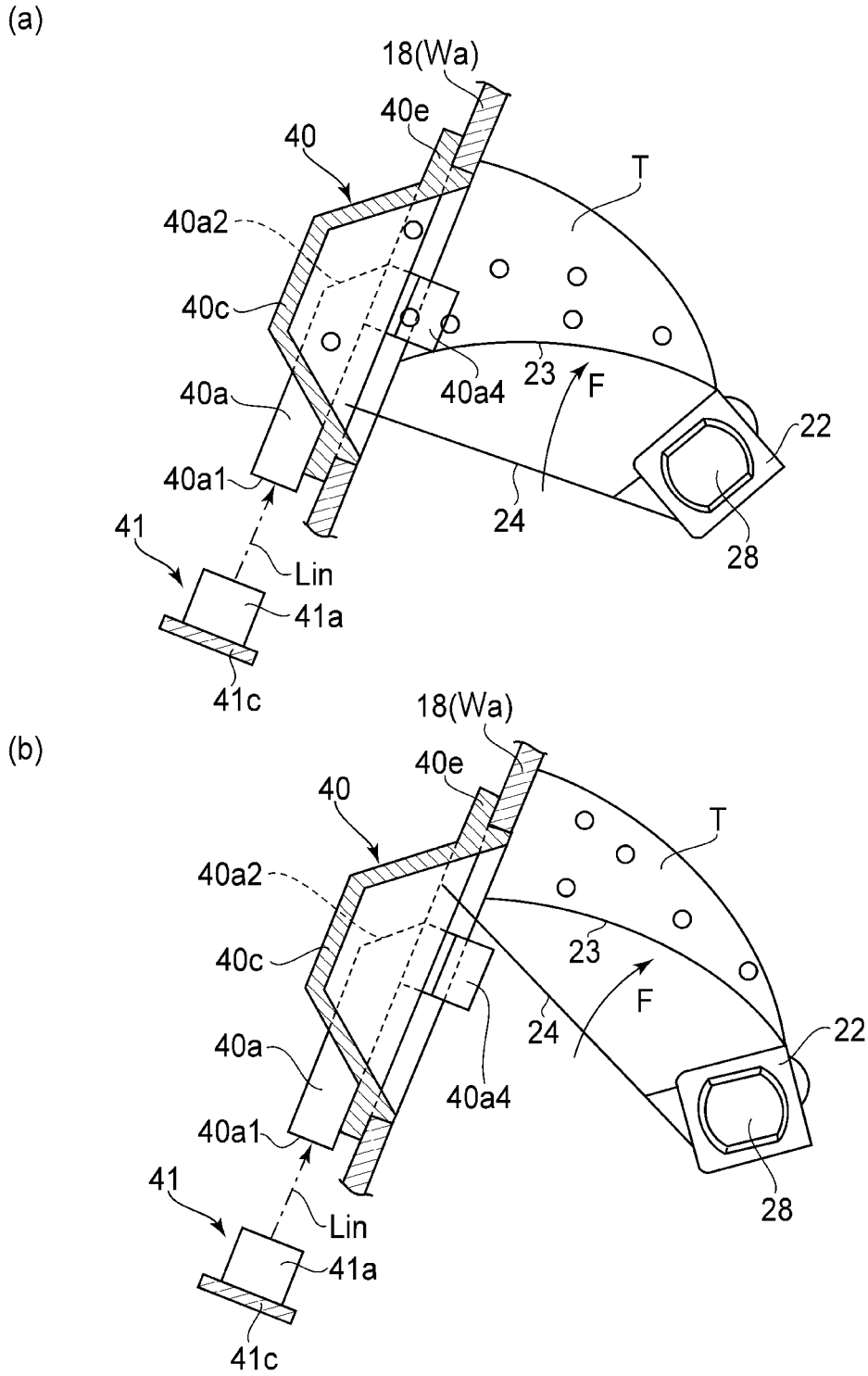
FIGS. 5(*a*) and 5(*b*) are schematic views for illustrating optical remaining toner amount detection.

On the other hand, when the toner is present between the light transmitting windows 40*a*4 and 40*b*4 projected toward the inside of the toner chamber 18*c*, the detection light L emitted from the light emitting portion 41*a* is blocked, so that the detection light L is not received by the light receiving portion 41*b*. Further, when there is no toner between the light transmitting windows 40*a*4 and 40*b*4, the detection light L emitted from the light emitting portion 41*a* is received by the light receiving portion 41*b* without being blocked. FIG. 5(*a*) is a schematic view showing a state immediately before the cleaning member 24 described later cleans the light transmitting windows 40*a*4 and 40*b*4. The detection light L is blocked inside the toner chamber 18*a* by the toner fed by the toner feeding member 23 and thus does not reach the light transmitting window 40*b*4 of the light receiving portion 40*b*, so that the detection light L is not detected by the light receiving portion 40*b*. On the other hand, FIG. 5(*b*) is a schematic view showing a state immediately after the cleaning member 24 cleans the light transmitting windows 40*a*4 and 40*b*4. The detection light L passes through the inside of the toner chamber 18*a* and is detected by the light receiving portion 41*b* through the light transmitting window 40*b*4 of the light receiving guide portion 40*b*.

As described above, the state in which the toner is present between the light transmitting windows 40*a*4 and 40*b*4 and the state in which the toner is not present between the light transmitting windows 40*a*4 and 40*b*4 are alternately formed due to flow of the toner by the rotation of the toner feeding member 23 depending on the image forming operation. Then, when a decrease in amount of the toner in the toner chamber 18*a*, a blocking time of the detection light L becomes shorter and on the other hand, a transmission time of the detection light L becomes longer. The control circuit portion 200 estimates the remaining toner amount in the toner chamber 18*c* by utilizing a change in blocking time and transmission time detected by the light receiving portion 41*b* depending on the toner amount based on the flow of the toner by the rotation of the toner feeding member 23. Then, the estimated remaining toner amount and a predetermined threshold are compared, so that precaution or warning of the lifetime end of the cartridge 7 is displayed on a display portion (not shown) of the operating portion 300.

(Structure of Rotation Shaft)

The rotation shaft 22 in the present invention will be described.

Figure 6:
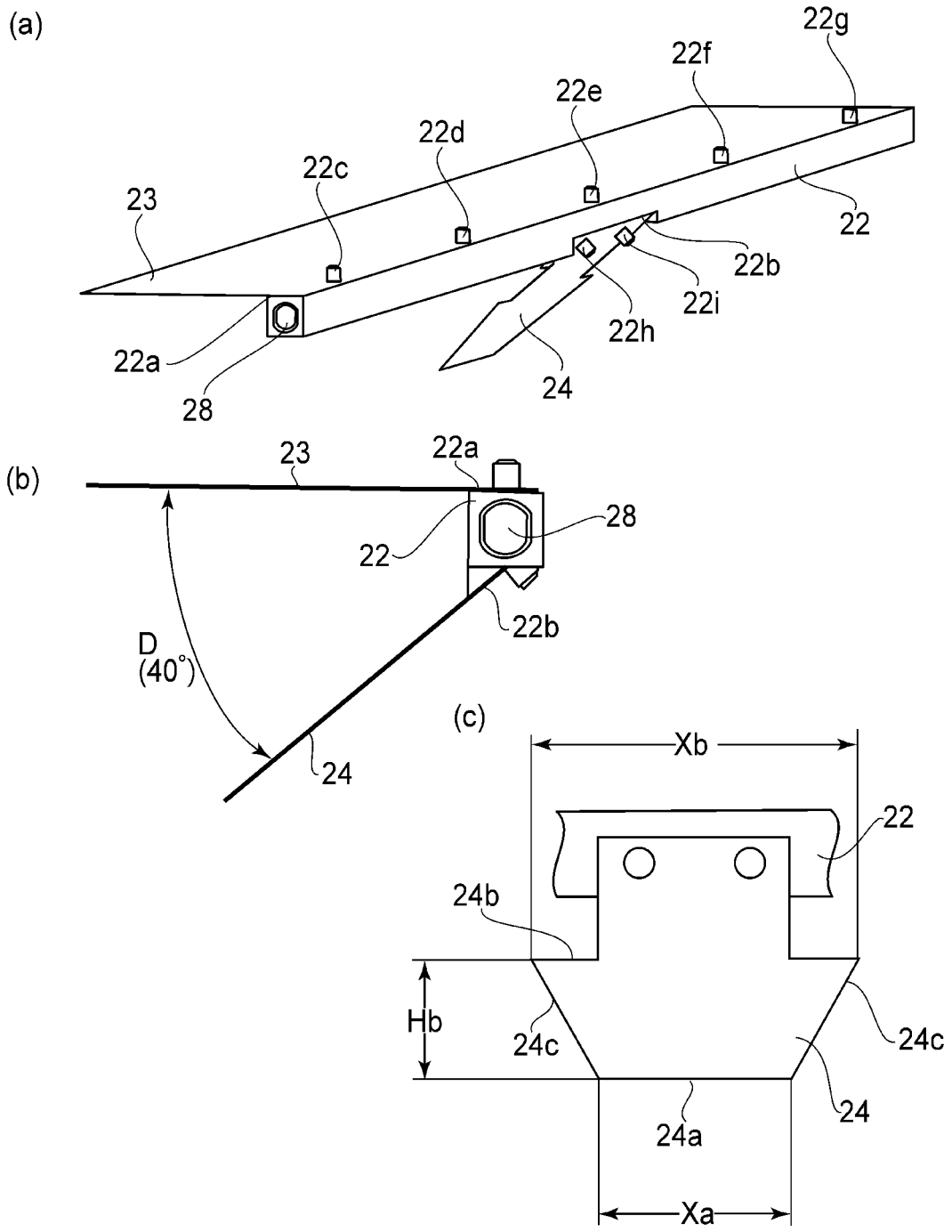
FIGS. 6 (*a*) to 6(*c*) are schematic structural views of a rotation shaft, a toner feeding member and a cleaning member.

As shown in FIG. 6(*a*), on a surface 22*a* constituting the rotation shaft 22, the toner feeding member 23 for performing the toner feeding is mounted in a substantially entire area of the toner feeding member 23 with respect to the longitudinal direction of the toner feeding member 23. The toner feeding member 23 is a rectangular sheet member suitably prepared by using a flexible resin-made sheet, such as a polyester film, a polyphenylene sulfide film, or a polycarbonate film, having a thickness of, e.g., 50-250 μm. The toner feeding member 23 is fixed to the rotation shaft 22 at one end thereof with respect to the radial direction (direction of the radius of gyration) by subjecting bosses 22*c* to 22*g*, provided to the rotation shaft 22, to thermal caulking or ultrasonic welding. The toner feeding member 23 is configured so that a length thereof is longer than a distance from the center of the rotation shaft 22 to the contact portion Wa1 of the inclined wall surface Wa by about 5 mm to about 20 mm.

To the rotation shaft 22, a surface 22*b* located oppositely to the mounting surface 22*a* of the toner feeding member 23 is provided with a phase D of 40 degrees with respect to the toner feeding member 23 in the counterclockwise direction is provided (FIG. 6(*b*)). The cleaning member 24 is fixed at the surface 22*b*, similarly as in the case of the toner feeding member 23, to the rotation shaft 22 at one end thereof with respect to the direction of the radius of gyration by subjecting bosses 22*h* and 22*i*, provided to the rotation shaft 22, to the thermal caulking or the ultrasonic welding. However, the phase of the cleaning member 24 with respect to the toner feeding member 23 may only be required to be set so that the free end of the toner feeding member 23 does not contact the cleaning member 24 when the toner feeding member 23 is deformed in contact with the inner wall surface of the toner chamber 18*a*, thus being not limited to 40 degrees.

FIG. 6(*c*) is a plan view of the cleaning member 24. As shown in FIG. 6, the free end of the cleaning member 24 has a trapezoidal shape such that an outer edge portion 24*a* of the cleaning member 24 with respect to the direction of the radius of gyration is narrow (Xa) and an inner edge portion 24*a* which is inwardly separated from the outer edge portion 24*a* (toward the rotation shaft 22 side) by a height Hb is wide (Xb), i.e., Xa<Xb. As described above with reference to FIG. 3(*b*), in this embodiment, the oppositely disposed] light transmitting windows 40*a*4 and 40*b*4 are formed so that the distance w4 therebetween on the side where they are close to the toner chamber 18*a* is more than the distance w5 therebetween on the side where they are away from the toner chamber 18*a*. Therefore, the cleaning member 24 is trapezoidally shaped by aligning its inclined surfaces with those of the oppositely disposed light transmitting windows 40*a*4 and 40*b*4 to improve cleaning power thereof. By the rotation of the cleaning member 24 by the rotation of the rotation shaft 22, the trapezoidally shaped cleaning member 24 has both inclined side edge portions 24*c* which contact the light transmitting windows 40*a*4 and 40*b*4, which are provided in a pair, to wipe out the toner deposited on the light transmitting windows 40*a*4 and 40*b*4. The cleaning member 24 can, e.g., be prepared suitably by using a flexible resin material-made sheet such as the polyester film or the polyphenylene sulfide film. The thickness of the sheet-like member may suitably be 50-250 μm in order that the cleaning member 24 an enter the spacing between the light transmitting windows 40*a*4 and 40*b*4.

The transmission of the driving force to the rotation shaft 22 is performed by a driving gear (not shown) which is inserted and engaged into an engaging hole 28 provided in an end portion of the rotation shaft 22 by penetration of the side wall of the toner chamber 18*a* to receive the driving force.

(Constitution of Toner Scattering Prevention)

Figure 7:
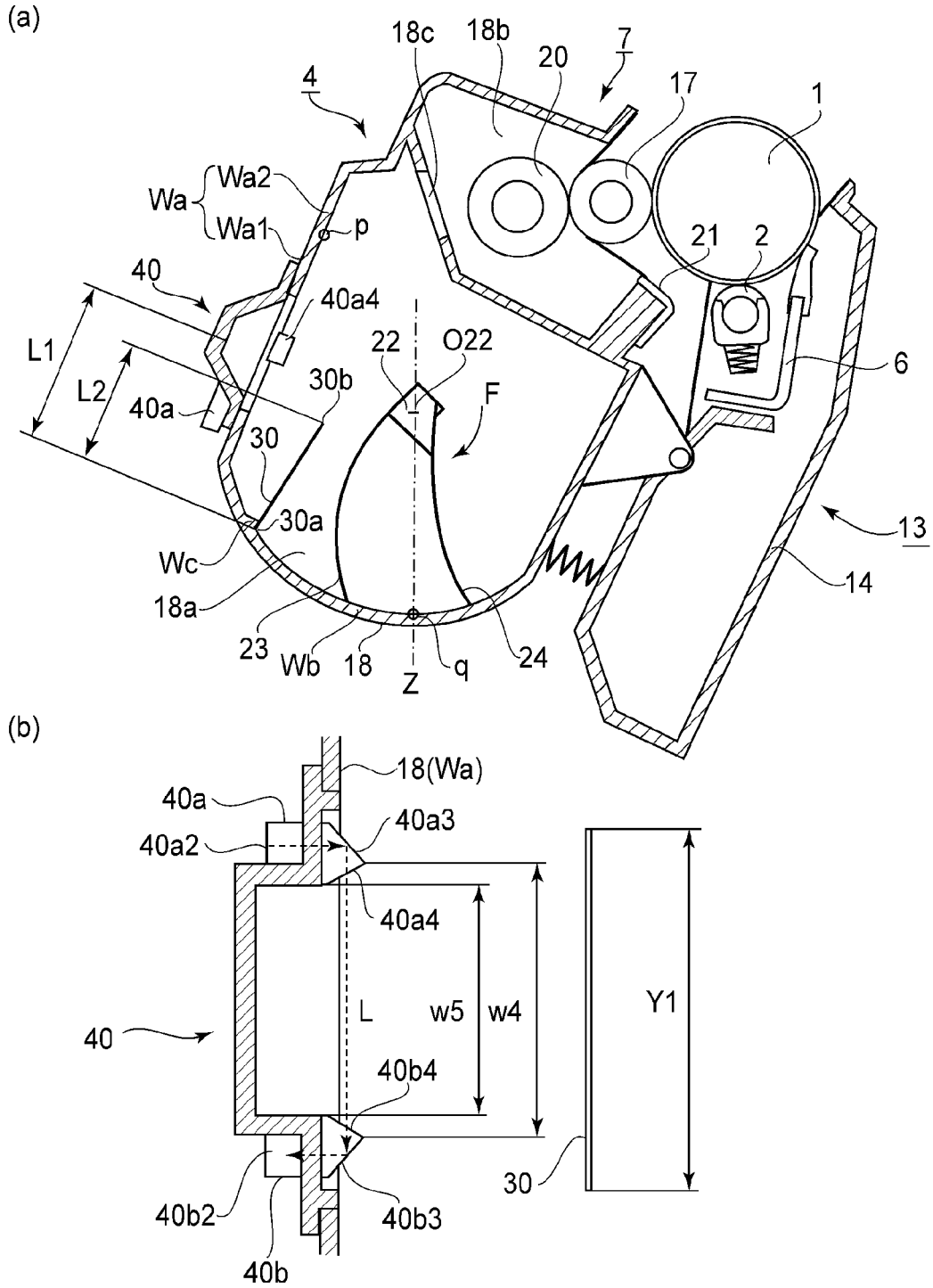
FIGS. 7(*a*) and 7(*b*) are schematic views for illustrating toner scattering preventing constitution in a toner chamber.

A toner scattering preventing constitution will be described with reference to FIGS. 7(*a*) and 7(*b*). FIG. 7(*a*) is a principal sectional view of the cartridge 7, and FIG. 7(*b*) is a schematic view showing a positional relationship between a toner scattering preventing member 30 and the light transmitting member 40 with respect to the axial direction of the rotation shaft 22. The toner chamber 18*a* is provided with the toner scattering preventing member 30 having flexibility so that a base portion 30*a* is mounted on the inner wall. More specifically, with respect to the rotational direction of the rotation shaft 22, the toner scattering preventing member 30 is provided on the inner wall bearing surface Wc at a position downstream of a line q of intersection of a vertical surface Z including a rotation center O22 (axis) of the rotation shaft 22 and the bottom wall surface Wb of the developer accommodating chamber and upstream the light transmitting windows 40*a*4 and 40*b*4. The toner scattering preventing member 30 is fixed on the inner wall bearing surface Wc at the base portion 30*a* by a double-side tape, thermal caulking, or the like.

A perpendicular height L2 of the toner scattering preventing member 30 from its mounting position (base portion 30*a*) to its free end 30*b* is set as follows. That is, the height L2 is set so that the toner scattering preventing member 30 does not interface with the light transmitting windows 40*a*4 and 40*b*4 when the toner scattering preventing member 30 is elastically deformed against elastic forces of the toner feeding member 23 and the cleaning member 24. For example, in the case where a perpendicular height L1 from the mounting position of the toner scattering preventing member 30 to the light transmitting window 40*a*4 is 20 mm, the perpendicular height L2 of the toner scattering preventing member 30 may preferably be 10-15 mm. Further, as shown in FIG. 7(*b*), a length Y1 of the toner scattering preventing member 30 is at least more than a length corresponding to the distance w4 between the light transmitting windows 40*a*4 and 40*b*4, i.e., Y1>w4 and in a range in which the light transmitting windows 40*a*4 and 40*b*4 are covered with the toner scattering preventing member 30. Here, from the viewpoint of prevention of the blocking of the light transmitting windows with the scattered toner, it is desirable that Y1>s4 is satisfied but, an effect to some extent can be obtained even when Y1<w4 is satisfied. That is, the toner scattering preventing member 30 is provided in a range in which the toner scattering preventing member 30 overlaps with at least the light transmitting member 40 with respect to the axial direction of the rotation shaft 22 as seen from a direction perpendicular to the toner scattering preventing member 30, and is located below the light transmitting member 40 (light transmitting windows 40*a*4 and 40*b*4).

Elastic modulus of the toner scattering preventing member 30 is set at a value smaller than that of the cleaning member 24 so as not to prevent the rotation of the cleaning member 24 when the toner scattering preventing member 30 contacts the cleaning member 24. For example, in the case where the cleaning member 24 is formed with a polyphenylene sulfide film in a thickness of 125-250 μm, it is preferable that the toner scattering preventing member 30 is formed with a polyester film in a thickness of 50-100 μm. Further, the elastic modulus of the toner scattering preventing member 30 is set at a value smaller than that of the toner feeding member 23 so as not to prevent the rotation of the toner feeding member 23 when the toner scattering preventing member 30 contacts the toner feeding member 23.

Figure 8:
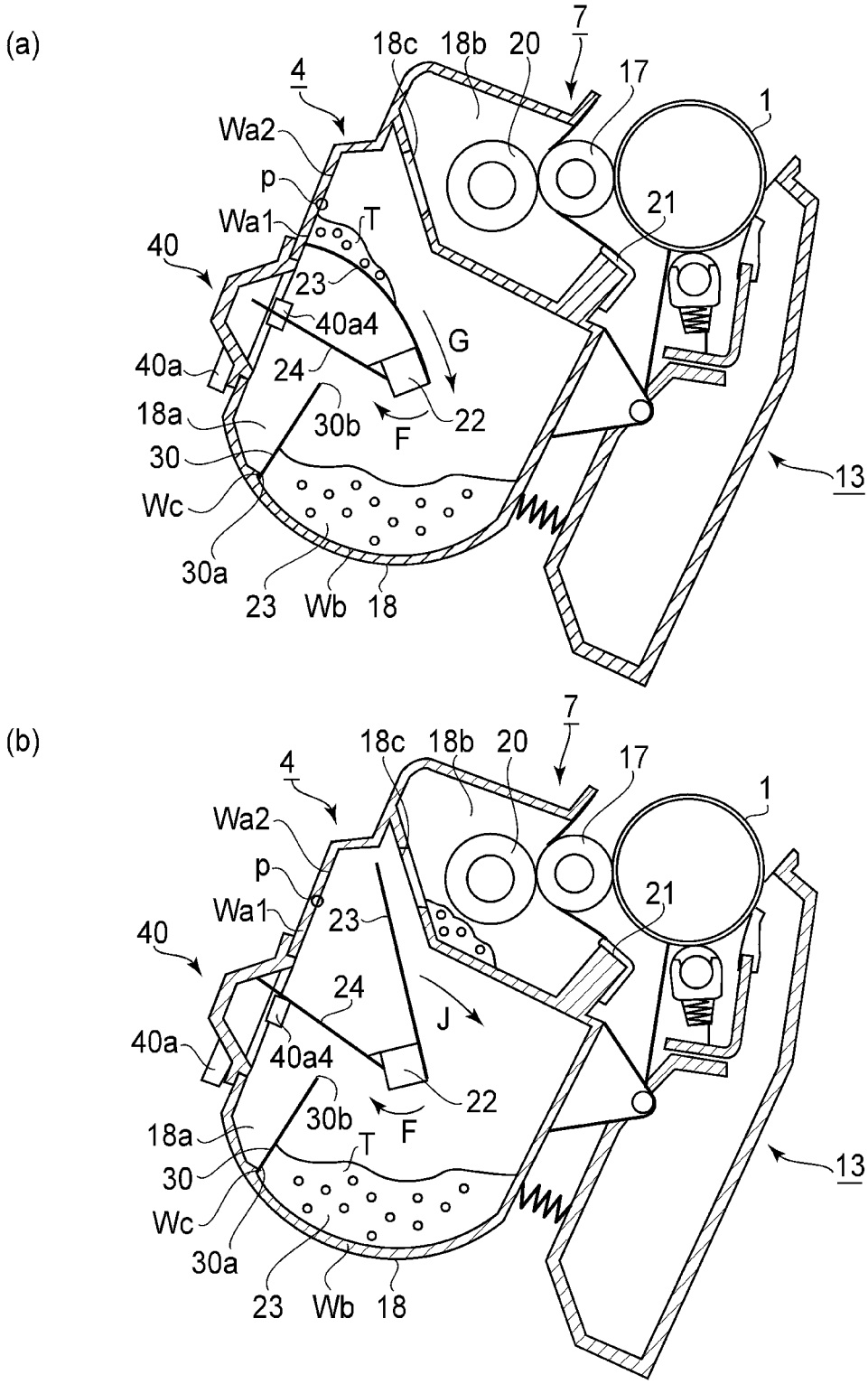
FIGS. 8(*a*) and 8(*b*) are schematic views for illustrating a state in which toner which has been feed is moved upward into a developing chamber, wherein FIG. 8(*a*) shows a state immediately before the toner feeding reaches a boundary point and FIG. 8(*b*) shows a state at the instant when deformation of the toner feeding is released.

FIGS. 8(*a*) and 8(*b*) are schematic views showing a state in which the toner is fed and then is leaped up into the developing chamber 18*b*, wherein FIG. 8(*a*) shows a state immediately before the toner feeding member 23 reaches the boundary point P. When the rotation shaft 22 is further rotated from the time when the mounting surface of the toner feeding member 23 is directed upward and placed in a horizontal state, the toner or the toner feeding member 23 slides off the surface of the toner feeding member 23 by the gravity in a direction of an arrow G. The toner sliding off the toner feeding member 23 until the toner feeding member 23 reaches the non-contact portion Wa2 of the toner chamber 18*a* is dropped on the bottom wall portion Wb in the toner chamber 18*a* as it is. At that time, the toner dropped on the bottom wall portion Wb is partly held back by the toner scattering preventing member 30 provided on the inner wall bearing surface We so that the toner scattering onto the light transmitting windows 40*a*4 and 40*b*4 by the toner dropping can be suppressed.

FIG. 8(*b*) shows a state of such a moment that the deformation of the toner feeding member 23 is eliminated. When the deformation of the toner feeding member 23 is drastically eliminated, in the toner chamber 18*a*, air flow J occurs toward the rotational direction of the toner feeding member 23 and at the same time, the toner which has not completely enter the developing chamber 18*b* is dropped into the toner chamber 18*a*. At this time, the toner scattering preventing member 30 is provided downstream of the rotation shaft 22 more than the toner feeding member 23 with respect to the rotational direction of the rotation shaft 22. For that reason, the air flow J which has occurred by the toner feeding member 23 and the scattered toner by the toner dropping are held back by the toner scattering preventing member 30 at a position before the light transmitting windows 40*a*4 and 40*b*4. As a result, even in the constitution in which the toner is fed upwardly by utilizing the elastic force of the toner feeding member 23, the light transmission-type remaining toner amount detection can be performed stably with accuracy.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 268425/2009 filed Nov. 26, 2009, which is hereby incorporated by reference.

What is claimed is:

1. A developing device for developing with a developer an electrostatic image formed on an image bearing member, said developing device comprising:

a rotatable developer carrying member for carrying and conveying the developer to the image bearing member;

a developing chamber in which said developer carrying member is provided;

a developer accommodating chamber, disposed and separated from said developing chamber by a wall surface provided with an opening through which the developer is passable, for accommodating the developer to be fed to said developing chamber;

a rotation shaft rotatably supported in said developer accommodating chamber;

a developer feeding member, mounted on said rotation shaft at one end thereof with respect to a radial direction of said rotation shaft, for feeding the developer by rotation of said rotation shaft while being deformed in contact with an inner wall of said developer accommodating chamber at the other end thereof;

a light transmitting member for permitting detection light to pass into said developer accommodating chamber in order to detect an amount of the developer in said developer accommodating chamber, wherein said light transmitting member is mounted on a wall surface of said developer accommodating chamber at a position upstream of the opening with respect to a rotational direction of said rotational shaft and downstream of a line of intersection between a vertical surface including an axis of said rotation shaft and a bottom constituting said developer accommodating chamber with respect to the rotational direction; and a developer scattering preventing member provided on the inner wall of said developer accommodating chamber so as to overlap with said light transmitting member with respect to an axial direction of said rotation shaft as seen in a direction perpendicular to said developer scattering preventing member, wherein an upper end of said developer scattering preventing member is located below said light transmitting member.

2. A device according to claim 1, wherein said developer scattering preventing member is provided downstream of the line of intersection and upstream of said light transmitting member with respect to the rotational direction of said rotation shaft.

3. A device according to claim 1, wherein said develop scattering preventing member has an elastic modulus smaller than that of said developer feeding member.

4. A device according to claim 1, further comprising a cleaning member for cleaning said light transmitting member, wherein said cleaning member is mounted on said rotation shaft at one end thereof with respect to the radial direction of said rotation shaft on an upstream side of said developer feeding member with respect to the rotational direction of said rotation shaft and slides on said light transmitting member at the other end thereof by the rotation of said rotation shaft, and wherein said developer scattering preventing member has an elastic modulus smaller than that of said cleaning member.

5. An image forming apparatus for forming an image on a recording material, comprising:

an image bearing member on which an electrostatic image is to be formed; and a developing device according to claim 1.

6. A process cartridge detachably mountable to a main assembly of an image forming apparatus, said process cartridge comprising:

an image bearing member on which an electrostatic image is to be formed;

a rotatable developer carrying member for carrying and conveying the developer to the image bearing member to develop the electrostatic image;

a developing chamber in which said developer carrying member is provided;

a developer accommodating chamber, disposed and separated from said developing chamber by a wall surface provided with an opening through which the developer is passable, for accommodating the developer to be fed to said developing chamber;

a rotation shaft rotatably supported in said developer accommodating chamber;

a developer feeding member, mounted on said rotation shaft at one end thereof with respect to a radial direction of said rotation shaft, for feeding the developer by rotation of said rotation shaft while being deformed in contact with an inner wall of said developer accommodating chamber at the other end thereof;

a light transmitting member for permitting detection light to pass into said developer accommodating chamber in order to detect an amount of the developer in said developer accommodating chamber, wherein said light transmitting member is mounted on a wall surface of said developer accommodating chamber at a position upstream of the opening with respect to a rotational direction of said rotational shaft and downstream of a line of intersection between a vertical surface including an axis of said rotation shaft and a bottom constituting said developer accommodating chamber with respect to the rotational direction; and a developer scattering preventing member provided on the inner wall of said developer accommodating chamber so as to overlap with said light transmitting member with respect to an axial direction of said rotation shaft as seen in a direction perpendicular to said developer scattering preventing member, wherein an upper end of said developer scattering preventing member is located below said light transmitting member.

7. A cartridge according to claim 6, wherein said developer scattering preventing member is provided downstream of the line of intersection and upstream of said light transmitting member with respect to the rotational direction of said rotation shaft.

8. A cartridge according to claim 6, wherein said develop scattering preventing member has an elastic modulus smaller than that of said developer feeding member.

9. A cartridge according to claim 6, further comprising a cleaning member for cleaning said light transmitting member, wherein said cleaning member is mounted on said rotation shaft at one end thereof with respect to the radial direction of said rotation shaft on an upstream side of said developer feeding member with respect to the rotational direction of said rotation shaft and slides on said light transmitting member at the other end thereof by the rotation of said rotation shaft, and wherein said developer scattering preventing member has an elastic modulus smaller than that of said cleaning member.

10. An image forming apparatus for forming an image on a recording material, comprising:

a process cartridge according to claim 6.

* * * * *